US010774608B2

(12) United States Patent
June

(10) Patent No.: US 10,774,608 B2
(45) Date of Patent: Sep. 15, 2020

(54) SUBSEA SYSTEM AND METHODOLOGY UTILIZING PRODUCTION RECEPTACLE STRUCTURE

(71) Applicant: OneSubsea IP UK Limited, London (GB)

(72) Inventor: David June, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/882,005

(22) Filed: Jan. 29, 2018

(65) Prior Publication Data

US 2018/0223619 A1 Aug. 9, 2018

Related U.S. Application Data

(60) Provisional application No. 62/454,111, filed on Feb. 3, 2017.

(51) Int. Cl.

| | |
|---|---|
| ***E21B 33/035*** | (2006.01) |
| ***E21B 33/038*** | (2006.01) |
| ***E21B 33/03*** | (2006.01) |
| ***E21B 33/04*** | (2006.01) |
| ***E21B 33/043*** | (2006.01) |
| ***E21B 34/04*** | (2006.01) |

(Continued)

(52) U.S. Cl.

CPC ..... *E21B 33/035* (2013.01); *E21B 33/03* (2013.01); *E21B 33/0385* (2013.01); *E21B 33/043* (2013.01); *E21B 33/0407* (2013.01); *E21B 34/04* (2013.01); *E21B 43/01* (2013.01); *E21B 43/128* (2013.01); *E21B 33/064* (2013.01)

(58) Field of Classification Search

CPC .. E21B 33/035; E21B 33/038; E21B 33/0385; E21B 33/04; E21B 33/0407; E21B 33/043; E21B 33/064; E21B 34/04; E21B 43/01; E21B 43/128

See application file for complete search history.

(56) References Cited

U.S. PATENT DOCUMENTS 3,186,488 A * 6/1965 Johnson ..... E21B 33/035 138/89
3,240,511 A * 3/1966 Bishop ..... E21B 33/038 166/377

(Continued)

OTHER PUBLICATIONS

Extended European Search Report issued in European Patent Appl. No. 18154656.5 dated Aug. 31, 2018; 7 pages.

*Primary Examiner* — James G Sayre
(74) *Attorney, Agent, or Firm* — Helene Raybaud

(57) ABSTRACT

A technique facilitates deployment of equipment, e.g. an electric submersible pumping system, in a subsea production operation. According to an embodiment, a subsea tree assembly, e.g. a horizontal subsea tree assembly, comprises a spool body housing having a channel extending therethrough. A production receptacle structure is secured within the channel and provides a reduced internal profile for securing wellbore equipment. For example, the internal profile may be constructed to sealably receive a cable hanger used to support power cable by which an electric submersible pumping system may be suspended. The production receptacle structure also may be equipped with a production stab for interfacing with a tubing hanger located below the production receptacle structure.

20 Claims, 2 Drawing Sheets

(51) Int. Cl.

| | |
|---|---|
| ***E21B 43/01*** | (2006.01) |
| ***E21B 43/12*** | (2006.01) |
| ***E21B 33/064*** | (2006.01) |

(56) References Cited

U.S. PATENT DOCUMENTS

| | | | | |
|---|---|---|---|---|
| 3,638,732 | A * | 2/1972 | Huntsinger | E21B 17/023 166/379 |
| 4,154,302 | A * | 5/1979 | Cugini | E21B 33/0407 166/378 |
| 5,052,941 | A * | 10/1991 | Hernandez-Marti | E21B 33/0385 166/65.1 |
| 7,025,132 | B2 * | 4/2006 | Kent | E21B 33/0355 166/368 |
| 2003/0019632 | A1 * | 1/2003 | Humphrey | E21B 33/035 166/368 |
| 2005/0067167 | A1 * | 3/2005 | Hall | E21B 33/038 166/379 |
| 2005/0109514 | A1 * | 5/2005 | White | E21B 43/01 166/368 |
| 2007/0246220 | A1 * | 10/2007 | Fenton | E21B 33/035 166/344 |
| 2014/0048277 | A1 * | 2/2014 | June | E21B 33/035 166/348 |
| 2015/0354308 | A1 | 12/2015 | June et al. | |
| 2016/0069178 | A1 * | 3/2016 | Mulholland | E21B 33/03 166/65.1 |
| 2016/0245034 | A1 | 8/2016 | June | |
| 2016/0245041 | A1 * | 8/2016 | Deacon | E21B 33/076 |

* cited by examiner

SUBSEA SYSTEM AND METHODOLOGY UTILIZING PRODUCTION RECEPTACLE STRUCTURE

CROSS-REFERENCE TO RELATED APPLICATION

The present document is based on and claims priority to U.S. Provisional Application Ser. No. 62/454,111, filed Feb. 3, 2017, which is incorporated herein by reference in its entirety.

BACKGROUND

In a variety of subsea production operations, electric submersible pumping systems are deployed downhole to a subsea borehole to facilitate production of the desired production fluid, e.g. oil. In some applications, the electric submersible pumping system is conveyed downhole to a desired location and suspended from a power cable. The power cable may be supported by a suitable cable hanger located in, for example, a tubing hanger working in cooperation with a subsea tree. Supporting the electric submersible pumping system from the tubing hanger, however, renders retrieval of the electric submersible pumping system time-consuming and expensive. Additionally, existing systems for suspending electric submersible pumping systems cause difficulties with respect to changing and/or servicing the subsea tree.

SUMMARY

In general, the present disclosure provides a system and methodology for deploying equipment, e.g. an electric submersible pumping system, in a subsea production operation. According to an embodiment, a subsea tree assembly, e.g. a horizontal subsea tree assembly, comprises a spool body housing having a channel extending therethrough. A production receptacle structure is secured within the channel and provides a reduced internal profile for securing wellbore equipment. For example, the internal profile may be constructed to sealably receive a cable hanger used to support a power line by which an electric submersible pumping system may be suspended. The production receptacle structure also may be equipped with features such as a production stab for interfacing with a tubing hanger located below the production receptacle structure.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
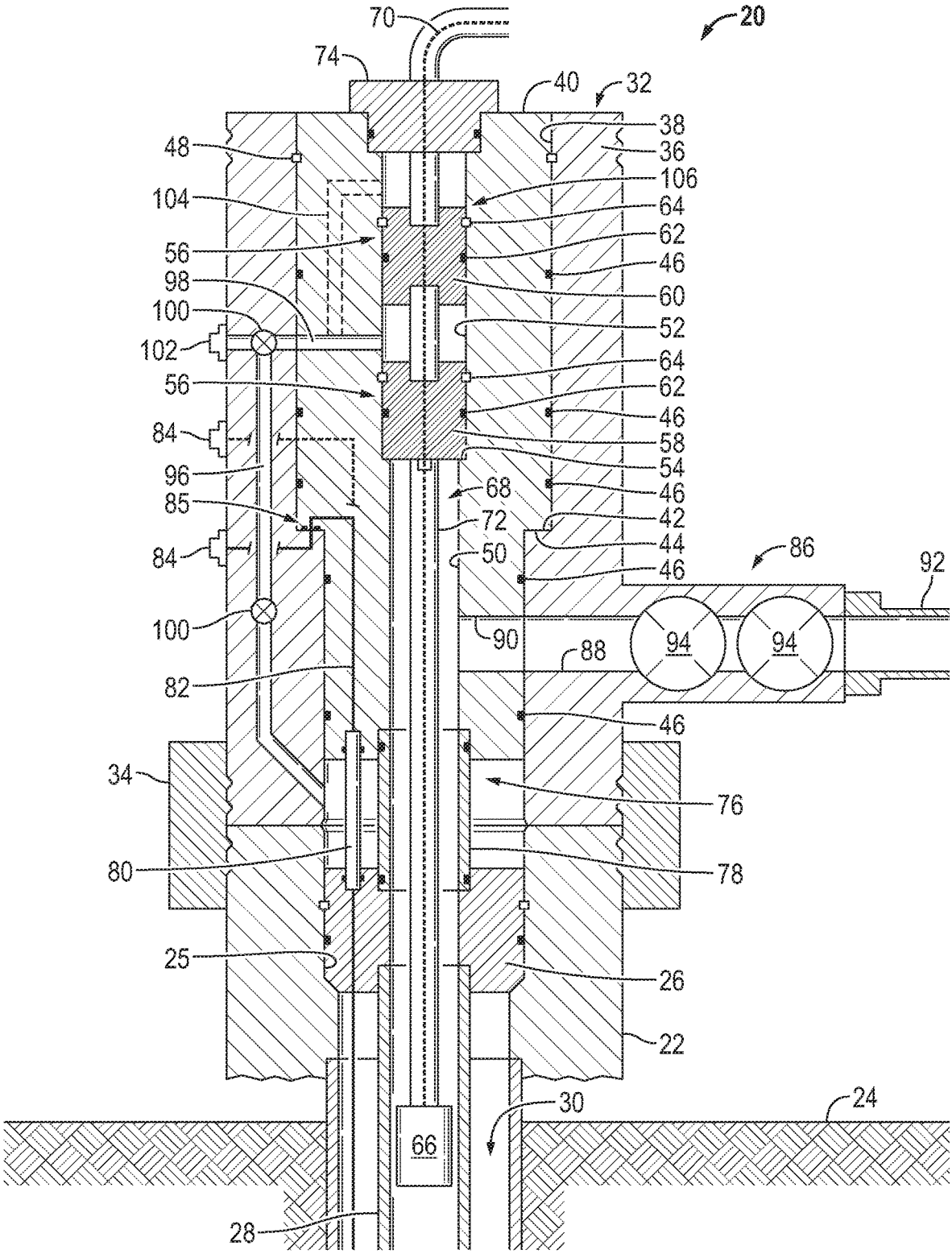
FIG. 1 is a schematic cross-sectional illustration of an example of a subsea installation comprising a spool body housing and a production receptacle structure secured therein, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for deploying equipment, e.g. deploying an electric submersible pumping system, in a subsea production operation. According to an embodiment, a subsea tree assembly, e.g. a horizontal subsea tree assembly, comprises a spool body housing having a channel extending therethrough. A production receptacle structure is positioned within the channel and provides a reduced internal profile for securing wellbore equipment. For example, the internal profile may be constructed to sealably receive a cable hanger used to support a power cable by which an electric submersible pumping system may be suspended.

The production receptacle structure also may be equipped with a production stab for interfacing with a tubing hanger located below the production receptacle structure. In some embodiments, the production receptacle structure also may utilize a control line coupler or a plurality of controlling couplers oriented to engage the tubing hanger. Additionally, the production receptacle structure may be removably mounted within the channel of the spool body housing and sealed thereto via a plurality of seals. The combined spool body housing and production receptacle structure may be mounted on a suitable subsea structure located over a well. By way of example, the subsea structure may be in the form of a tubing head spool or wellhead.

According to one example, the spool body housing is part of a horizontal tree assembly through which the channel extends generally vertically and has a given diameter. In some embodiments, the diameter may change along the length of the generally vertical channel. The production receptacle structure may be constructed in the form of a mandrel for use in suspending an electric submersible pumping system or other equipment located downhole in a borehole.

The production receptacle structure/mandrel may be secured within the generally vertical channel to occupy the given diameter. Additionally, the production receptacle structure may have various types of internal profiles extending therethrough, the internal profile providing a reduced diameter relative to the diameter of the channel. The internal profile may be configured and selected for the purpose of securing desired types of wellbore equipment, e.g. a cable hanger and a wellbore closure apparatus.

In pumping system embodiments, a cable may be coupled between the electric submersible pumping system and the cable hanger which is landed and sealed along the internal profile. The lower end of the production receptacle structure may have a variety of configurations and/or features to enable interfacing with a corresponding tubing hanger located therebelow. According to an embodiment, the production receptacle structure may comprise or cooperate with a production stab as well as one or more control line couplers oriented to engage corresponding features in a tubing hanger. Consequently, the production receptacle structure is able to stab into the top of, for example, a vertical monobore tubing hanger which, in turn, is landed in a tubing spool or wellhead.

Depending on the application, the lower end of the production receptacle structure, e.g. mandrel, may be machined and/or otherwise formed to engage various types of tubing hangers. This allows the horizontal tree assembly, with its production receptacle structure, to be constructed as a replacement assembly. For example, when a relatively more expensive vertical tree is no longer desired, the vertical tree can be removed from the wellhead/tubing head spool and the less expensive horizontal tree assembly can be delivered to the subsea location and secured to the wellhead/tubing head spool. The production receptacle structure enables straightforward coupling with the existing tubing hanger.

In a wide variety of servicing and replacement procedures, the procedure may be performed without removing or affecting the tubing hanger. The production receptacle structure of the horizontal tree, for example, may simply be moved into engagement with the existing tubing hanger. The ability to remove, service, and replace the subsea tree without affecting the tubing hanger enables more rapid and less expensive replacement of or servicing of subsea equipment, e.g. servicing of the electric submersible pumping system. The structure of the horizontal tree combined with the production receptacle structure/mandrel also may help reduce the height and weight of current subsea installations used for through-tubing electric submersible pumping systems. Effectively, the production receptacle structure can be used to convert the bottom of a horizontal tree into the bottom of a functional vertical tree.

According to a procedural example, the horizontal tree containing the production receptacle structure may be landed on a tubing spool that houses a vertical tubing hanger following removal of the original vertical tree. By way of example, this type of procedure can be done to provide a tree with a larger bore, e.g. a larger internal profile, which allows passage of an electric submersible pumping system through the tree when the original tree would not allow such passage. Instead of building a new vertical tree with larger valves able to pass the pumping system, the simpler, less expensive horizontal tree (with production receptacle structure) can simply be deployed as a replacement tree.

Referring generally to FIG. 1, an example of a subsea well installation 20 is illustrated. In this embodiment, the subsea well installation 20 comprises a well structure 22 which may be mounted generally along a sea floor 24. By way of example, the illustrated well structure 22 comprises a tubing head spool or a wellhead having an internal profile 25 into which a tubing hanger 26 is landed. The tubing hanger 26 may be sealed and locked in place along internal profile 25. A tubing 28, e.g. production tubing, may be suspended from the tubing hanger 26 such that the tubing 28 extends down into a casing bore 30, e.g. a cased wellbore. In this example, tubing hanger 26 is a vertical tubing hanger landed in the tubing head spool/wellhead 22.

In the embodiment illustrated, the subsea well installation 20 further comprises a horizontal tree assembly 32 which may be landed on the well structure 22 and secured thereto by a suitable connector device 34. By way of example, the horizontal tree assembly 32 comprises a spool body housing 36 having a channel 38 extending therethrough. As illustrated, the channel 38 may extend generally vertically through the spool body housing 36 when the horizontal tree assembly 32 is landed on well structure 22.

The channel 38 has a given diameter sized to receive a production receptacle structure 40, e.g. a mandrel. Depending on the application, the diameter of the channel 38 may change to provide, for example, an abutment 42 or other features used to hold the production receptacle structure 40 at a desired position within the channel 38. For example, the production receptacle structure 40 may have a corresponding abutment 44 oriented to engage abutment 42 when the production receptacle structure 40 is inserted into channel 38. By way of example, the production receptacle structure 40 may be assembled into the horizontal tree assembly 32 at a surface manufacturing facility, e.g. a land-based facility or offshore platform, or it may be landed into channel 38 subsea.

The production receptacle structure 40 also may comprise seals 46 positioned at desired locations along its exterior to ensure the appropriate sealing between the production receptacle structure 40 and the surrounding spool body housing 36. In some embodiments, the production receptacle structure 40 is removable from spool body housing 36—although a locking mechanism (or mechanisms) 48 may be used to ensure the production receptacle structure 40 remains secured in channel 38 during operation. By way of example, locking mechanism 48 may comprise a split ring positioned in corresponding grooves of housing 36 and structure 40.

In the embodiment illustrated, the production receptacle structure 40 has an internal passage 50 extending therethrough. The internal passage 50 is defined by an internal profile 52 which has a reduced diameter compared to the diameter of channel 38. The internal profile 52 is appropriately sized and may comprise features, e.g. a profile abutment 54, which helps support wellbore equipment 56. By way of example, the wellbore equipment 56 may comprise a suspension apparatus 58, e.g. a cable hanger, and a cable plug 60. The cable plug 60 forms a second barrier along passage 50. Equipment 56 such as the cable hanger 58 and cable plug 60 may comprise seals 62 to ensure sealing between the equipment 56 and the surrounding production receptacle structure 40. In some embodiments, locking mechanisms 64, e.g. lock rings, also may be used to secure the equipment, e.g. cable hanger 58 and/or cable plug 60, along internal profile 52. It should be noted that in some embodiments, the cable hanger 58 may be in the form of a plug without an electrical pass through. For example, the cable hanger 58 and/or cable plug 60 may be in the form of wireline plugs or other types of devices positioned along internal profile 52.

The cable hanger 58 may be positioned and secured along the internal profile 52 for suspending downhole equipment such as the illustrated electric submersible pumping system 66. The electric submersible pumping system 66 (and/or other downhole equipment) may be suspended within tubing 28 via a power line 68 having a suitable conductor or conductors 70 able to deliver electrical power from a power source down through tubing hanger 26 to the electric submersible pumping system 66 (and/or other downhole equipment). In the illustrated example, the power line 68 is in the form of a power cable 72 secured to cable hanger 58, however the power line 68 may be constructed in other configurations, e.g. coiled tubing with internal conductors. As illustrated, the power line 68 may be routed up through cable hanger 58, cable plug 60, and a debris cap 74 to a suitable power source, such as a surface-based power source. The cable hanger 58 and the cable plug 60 may be used as redundant seals to prevent unwanted escape of fluids along the internal passage 50. Depending on the type of conductors 70 routed into production receptacle structure 40, the debris cap 74 may be replaced or supplemented with an open water cap, a flying lead attachment cap, a tree adjacent flying lead connection, or other suitable device.

A lower end 76 of the production receptacle structure 40 may have a variety of configurations for engagement with tubing hanger 26. In some embodiments, the production receptacle structure 40 comprises or works in cooperation with a production stab 78 oriented to stab into the tubing hanger 26 located therebelow. The production receptacle structure 40 also may comprise or work in cooperation with other features, such as at least one control line coupler 80, e.g. a plurality of control line couplers 80, also oriented to stab into tubing hanger 26. Each control line coupler 80 is coupled with a corresponding control line 82, e.g. an electrical or hydraulic control line. The control lines 82 may be routed below tubing hanger 26 to desired downhole equipment and also to an external connection 84, e.g. a block mounted valve, which may be located along an exterior of spool body housing 36 or at another suitable location. The control line or control lines 82 may be routed from production receptacle structure 40 to spool body housing 36 between seals 46 and/or through a special seal region 85 and then on to one or more of the external connections 84.

The production stab 78, control line couplers 80, and/or other features of lower end 76 may be configured and oriented for engagement with many types of tubing hangers 26. Consequently, the production receptacle structure 40 can simply be stabbed into engagement with the existing tubing hanger 20 when horizontal tree assembly 32 is landed on the well structure 22.

In some embodiments, the horizontal tree assembly 32 may comprise a lateral arm 86, e.g. a horizontal arm, having a production flow passage 88. In some embodiments, the lateral arm 86 comprises a wing block. The production flow passage 88 may be placed in fluid communication with a corresponding passage 90 located through a side wall forming production receptacle structure 40. The corresponding passage 90 is in fluid communication with internal profile 52. Consequently, operation of electric submersible pumping system 66 produces well fluid up through tubing 28, through tubing hanger 26, into internal passage 50, out through corresponding passage 90, and through production flow passage 88 of lateral arm 86, to a corresponding flow tubing 92.

At least one valve 94, e.g. a production valve, may be positioned in lateral arm 86 to provide selective control over fluid moving along production flow passage 88. In some embodiments, redundant valves 94, e.g. a pair of valves 94, may be placed in lateral arm 86 along production flow passage 88 to provide redundant capability for shutting off flow through passage 88. The valves 94 serve as control barriers located along a controllable flow path.

Depending on the parameters of a given operation, the subsea installation 20 and horizontal tree assembly 32 may have a variety of configurations and features. In some embodiments, for example, an annulus flow capability with respect to the annulus surrounding production tubing 28 may be facilitated by providing an annulus flow run passage 96 routed through the spool body housing 36. By way of example, the annulus flow run passage 96 may be placed in fluid communication with channel 38 below production receptacle structure 40 and with internal profile 52 at, for example, a location between cable hanger 58 and cable plug 60. A corresponding annular flow passage 98 may be located laterally through the wall forming production receptacle structure 40.

Additionally, suitable valves 100 as well as an external fluid coupling 102 may be located along the annular flow passage 98. In some embodiments, an additional flow run passage 104 may be located in the wall of production receptacle structure 40 to provide communication between passage 98 and internal profile 52 at a location above cable plug 60. Various other features also may be incorporated into components of the overall subsea well installation 20 to accommodate various subsea operations. For example, such features may include a crossover passage from annulus to production for circulation.

Figure 2:
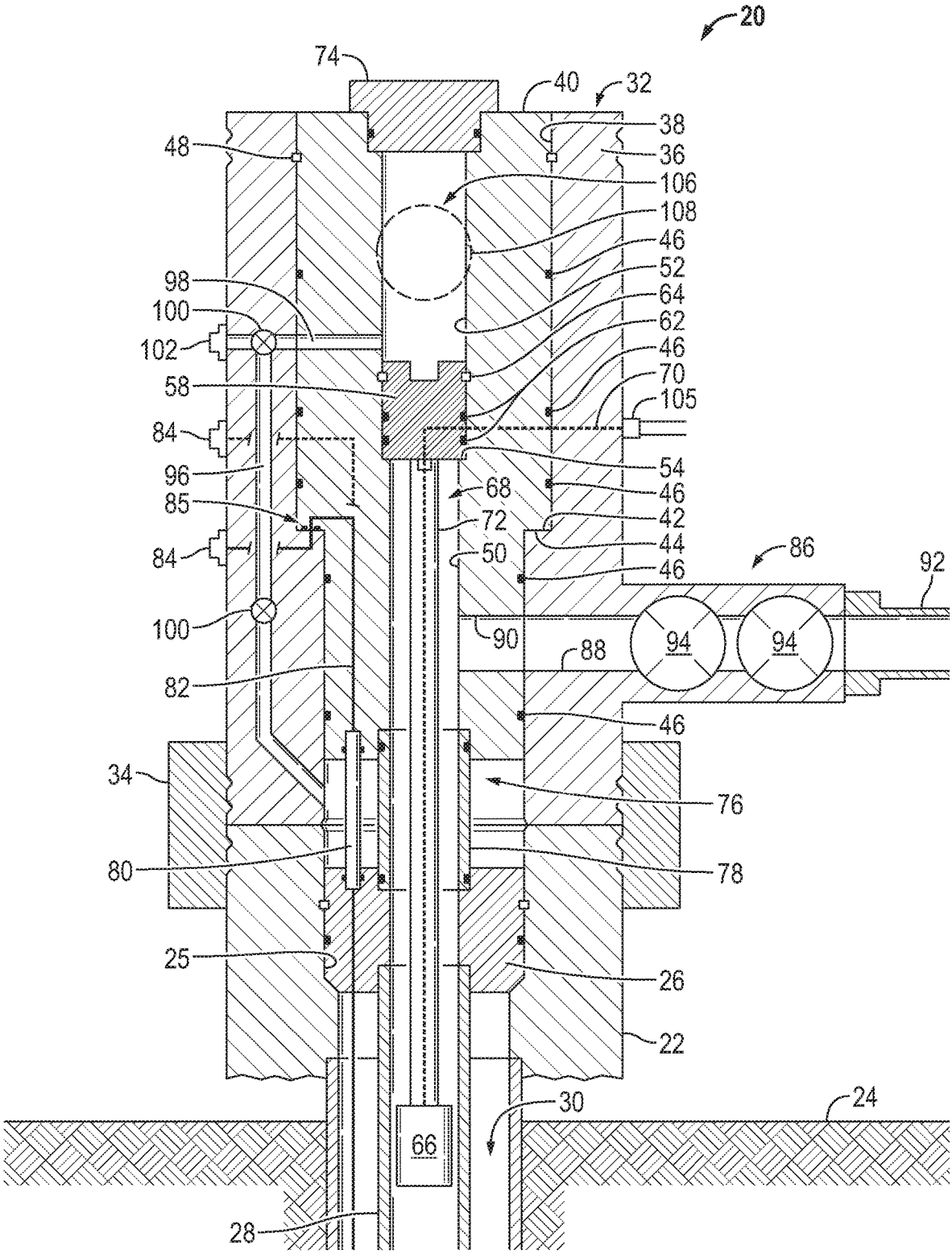
FIG. 2 is a schematic cross-sectional illustration of another example of a subsea installation comprising a spool body housing and a production receptacle structure secured therein, according to an embodiment of the disclosure.

Referring generally to FIG. 2, another embodiment of subsea well installation 20 and horizontal tree assembly 32 is illustrated. In this embodiment, the electric submersible pumping system 66 is again suspended from cable hanger 58 via power line 68, e.g. power cable 72. However, the electrical lead/conductor 70 is routed laterally through spool body housing 36 and production receptacle structure 40 before entering cable hanger 58 between a pair of the seals 62. The electrical lead/conductor 70 may be routed through an external electrical coupler 105 located along the exterior of spool body housing 36.

Additionally, a wellbore closure apparatus 106 is positioned along internal profile 52 above cable hanger 58 so as to provide a redundant seal along internal profile 52. In some embodiments, the wellbore closure apparatus 106 may comprise cable plug 60. In the illustrated embodiment, however, the wellbore closure apparatus 106 comprises a valve 108, e.g. a workover valve, which may be selectively opened to allow flow along internal profile 52 or closed against flow along internal profile 52. For example, the valve 108 may be closed during a production mode in which electric submersible pumping system 66 is operated to produce a well fluid. When in the closed position, the wellbore closure apparatus 106 works in cooperation with cable hanger 58 to provide redundant control barriers along a potential leak path. In some embodiments, the valve 108, when opened, may be of sufficient size to accommodate passage of electric submersible pumping system 66 and cable hanger 58 therethrough during deployment. Additionally, the wellbore closure apparatus 106 may comprise other types of devices, such as a wireline plug. In some embodiments, the cable hanger 58 may be in the form of a wireline plug. By way of example, devices 58, 106 may be in the form of two plugs deployed along passage 50 to provide suitable barriers without electrical conductor 70 passing therethrough.

Embodiments described herein provide an electric submersible pumping system completion approach utilizing the production receptacle structure 40 to house cable hanger 58 instead of using other features, e.g. tubing hanger 26. If a cable hanger is placed in the tubing hanger, damage to the tubing hanger profile can result in costly retrieval of the tubing hanger. In contrast, embodiments described herein reduce or eliminate the risk of damage to the tubing hanger by positioning cable hanger 58 in production receptacle structure 40. As a result, repairs or servicing of the present system involve the much less expensive operation of retrieving the tree assembly 32 (or possibly even the production receptacle structure 40 itself). Use of the production receptacle structure 40 can facilitate many types of operations, including servicing of the electric submersible pumping systems. The production receptacle structure 40 may be configured to interface with many types of horizontal trees, including off-the-shelf horizontal trees, with no modification or limited modification of the horizontal tree.

The production receptacle structure 40 and corresponding spool body housing 36 also may be used as a solution for completion scenarios other than electric submersible pumping system completions. For example, the production receptacle structure 40 can provide a location to suspend, seal off, or lockdown related equipment such as plugs, e.g. wireline plugs, or well suspended conduits. Depending on the application, the production receptacle structure 40 may contain many types of control line couplers, including electrical couplers and hydraulic couplers, oriented for stabbing into the tubing hanger 26 located therebelow.

Additionally, the production receptacle structure 40 may be placed into the horizontal tree assembly 32 at the factory, offshore, or subsea. Once installed, the production receptacle structure 40 provides a new profile for suspension equipment and/or well control devices.

According to an operational example, the horizontal tree assembly 32 described herein may be constructed to facilitate deployment of electric submersible pumping systems 66. In such an embodiment, the production receptacle structure 40 may be constructed for engagement with an existing vertical tubing hanger 20. This allows, for example, an existing vertical tree which is not ready for an electric submersible pumping system to be removed and easily replaced by the horizontal tree assembly 32. As described above, the horizontal tree assembly 32 is readily configurable to provide two barriers along the lateral production passage 88 of lateral arm 86 via two production valves 94.

In some embodiments, the production receptacle structure 40 may have an upper seal profile configured to accept a workover riser connection or stab. The workover riser may be referred to as a blowout preventer (BOP) unit riser system or a lightweight intervention riser system. Additionally, the configuration of horizontal tree assembly 32 enables the use of many types of electric submersible pumping systems 66 suspended by, for example, power cable 72 and installed through the production tubing 28 rather than being attached to and the suspended from the production tubing 28. The workover riser is able to provide a pressure contained conduit from the surface to the well for purposes of installing the through-tubing electric submersible pumping system 66.

The production receptacle structure 40 and its internal profile 52 may have various features to facilitate landing, locking, and sealing of internal equipment, such as cable hanger 58 and cable plug 60. Depending on the application, various valves 94, 106 may be located in the vertical and horizontal passages. Accordingly, the overall subsea well installation 20 as well as the horizontal tree assembly 32 may have a variety of configurations and features to accommodate many types of subsea operations.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use with a subsea well, comprising:

a horizontal tree assembly having:

a spool body housing defining a channel therethrough;

a production receptacle structure slidably mounted within the channel and releasably secured within the channel, the production receptacle structure providing an internal profile for securing wellbore equipment, the internal profile having a reduced diameter relative to the diameter of the channel, the internal profile further comprising a profile abutment;

a plurality of seals positioned around the production receptacle structure to ensure sealing between the production receptacle structure and the spool body housing;

a wellbore equipment supported in the internal profile by the profile abutment, the wellbore equipment being removable and landable in the production receptacle structure; and a cap sealably and removably mounted in the internal profile above the well equipment;

the production receptacle structure being equipped with a production stab to removably interface with a tubing hanger located below the spool body housing to enable removal and landing of the spool body housing and production receptacle structure without removing the tubing hanger.

2. The system as recited in claim 1, wherein the wellbore equipment comprises a suspension apparatus secured within the internal profile, a power line being suspended therefrom and extending down through the tubing hanger.

3. The system as recited in claim 2, wherein the suspension apparatus comprises a cable hanger seal along the internal profile; and the power line comprises a power cable.

4. The system as recited in claim 2, further comprising a wellbore closure apparatus deployed along the internal profile.

5. The system as recited in claim 4, wherein the wellbore closure apparatus comprises a plug.

6. The system as recited in claim 4, wherein the wellbore closure apparatus comprises a valve.

7. The system as recited in claim 2, wherein the power line is routed to the suspension apparatus laterally through a wall of the spool body housing.

8. The system as recited in claim 2, further comprising an electric submersible pumping system suspended by the power line.

9. The system as recited in claim 1, wherein the production receptacle structure is equipped with at least one control line coupler to interface with the tubing hanger.

10. The system as recited in claim 1, further comprising at least one valve secured at the spool body housing, the at least one valve being positioned to provide controlled access to and from the channel.

11. The system as recited in claim 10, wherein the at least one valve comprises a pair of valves.

12. The system as recited in claim 1, wherein the spool body housing is landed on a tubing head spool, and the tubing hanger is located in the tubing head spool.

13. The system as recited in claim 1, wherein the spool body housing is landed on a wellhead, and the tubing hanger is located in the wellhead.

14. A system, comprising:

a spool body housing having a lateral arm containing a pair of production valves, the spool body housing defining a generally vertical channel therethrough;

a production receptacle structure secured in the generally vertical channel and providing an internal profile of reduced diameter compared to a diameter of the generally vertical channel, the production receptacle structure extending past the lateral arm, the production receptacle structure comprising a passage through a side wall of the production receptacle structure to enable fluid communication between the internal profile and the pair of production valves, the production receptacle structure further being equipped with a production stab located below the lateral arm, the production stab being oriented to removably engage a tubing hanger positioned therebelow to enable removal and landing of the spool body housing and the production receptacle structure without removing the tubing hanger; and a suspension apparatus secured within the internal profile to suspend a power line extending down through the tubing hanger, the suspension apparatus and the power line being removable and landable in the production receptacle structure without removing the spool body housing and the production receptacle structure from the tubing hanger.

15. The system as recited in claim 14, wherein the suspension apparatus comprises a cable hanger sealed along the internal profile; and the power line comprises a power cable.

16. The system as recited in claim 14, further comprising a wellbore closure apparatus disposed along the internal profile above the suspension apparatus.

17. The system as recited in claim 14, further comprising an electric submersible pumping system suspended by the power line.

18. A method, comprising:

removably positioning a production receptacle structure in a channel within a spool body housing located at a subsea well;

sealably engaging the production receptacle structure with the spool body housing via a plurality of seals located along the channel;

suspending an electric submersible pumping system from the production receptacle structure via a removable cable hanger landed against a profile abutment located in an internal profile of the production receptacle structure; and engaging the production receptacle structure with a tubing hanger via a production stab and a control line coupler, the production receptacle structure and the electric submersible pumping system being removable without removing the tubing hanger, the electric submersible pumping system further being independently landable in the production receptacle structure.

19. The method as recited in claim 18, further comprising operating the electric submersible pumping system to produce a production fluid up into the internal profile and out through a lateral arm of the spool body housing.

20. The method as recited in claim 19, further comprising positioning redundant production valves along the lateral arm.

* * * * *